United States Patent [19]

Parker

[11] 4,209,935

[45] Jul. 1, 1980

[54] APPARATUS FOR ROCKET SLED GAME

[76] Inventor: Herman Parker, P.O. Box 1071, McAlester, Okla. 74501

[21] Appl. No.: 871,172

[22] Filed: Jan. 23, 1978

[51] Int. Cl.[2] ..... A63H 18/14; A63H 29/10

[52] U.S. Cl. ..... 46/44; 46/1 K; 273/86 D

[58] Field of Search ..... 46/44, 248, 206, 1 K; 273/86 D, 85 H, 86 R

[56] References Cited

U.S. PATENT DOCUMENTS

| | | | |
|---|---|---|---|
| 3,224,771 | 12/1965 | Altieri | 46/206 X |
| 3,367,658 | 2/1968 | Bayha | 46/44 X |
| 3,611,622 | 10/1971 | Lemelson | 46/44 |
| 3,697,071 | 10/1972 | Anderson | 46/44 |
| 3,885,344 | 5/1975 | Tong | 46/44 |
| 3,987,581 | 10/1976 | Brown | 273/86 D |

*Primary Examiner*—Russell R. Kinsey
*Assistant Examiner*—Mickey Yu
*Attorney, Agent, or Firm*—James H. Chafin

[57] ABSTRACT

An air-powered rocket sled game which includes a base having a pair of closed intersecting grooved tracks of substantially equal length in the upper surface thereof and a pair of air ducts in the interior of said base, each duct being in open communication with one of the grooved tracks through a plurality of spaced bores; a pair of projectiles adapted for slidably fitting in the grooved tracks and individually controlled means for introducing a continuous flow of compressed air into each air duct to thereby force the projectiles along the tracks.

5 Claims, 9 Drawing Figures

APPARATUS FOR ROCKET SLED GAME

BACKGROUND OF THE INVENTION

This invention relates to a game which may be used for individual entertainment or by a pair of opponents competitively. In the past, a great number of toys and games have been devised which pits the dexterity or skill of the players in opposition as they attempt to manuever miniature racing cars along a fixed track. These cars are normally individually controlled by the players by electrical transformers energizing the track to provide power for the vehicle electric motors. The popularity of such devices has been immense as evidenced by the myriad of types and numbers marketed.

Due to the nature of the power supply and the abuse received at the hands of children, however, the aforementioned devices rarely work for prolonged periods of time.

It is therefore an object of this invention to provide a competitive racing rocket sled game which is economical to manufacture, extremely durable, and safe for children of all ages.

SUMMARY OF THE INVENTION

The preferred embodiment of the rocket sled game disclosed herein is designed for the competitive racing of a pair of projectiles or rocket sleds around two adjacent closed tracks of equal length.

As each track and rocket sled cooperate in the same manner, a description of the functioning of a single track and sled will suffice. Included in the invention is a base having a substantially U-shaped groove in the upper surface thereof and having an air duct in the interior of said base substantially underlying said groove. The groove, which serves as a track for the projectile, and the air duct are in communication with each other through a plurality of spaced bores entering the bottom of the groove at an acute angle. A centrifugal fan, driven at substantially constant speed, provides a continuous supply of air to a branched exhaust duct within the base, one branch of said duct opening to the air duct underlying the base groove and the remaining branch exhausting to the atmosphere. A manually operated gate is provided at the exhaust duct branch point which permits the operator to divert as much of the air from the fan to his air duct as may be desired, with the remainder of the air being vented to the atmosphere.

A projectile or rocket sled is provided which slidably fits in the groove and is sufficiently light in weight so as to be propelled along the track by the air passing through the boxes to the groove.

Preferably, the centrifugal fans which supply the air to each track are belt driven from a common electrical motor, thus insuring power euqality between the operators.

DETAILED DESCRIPTION OF THE PREFERRED EMBODIMENT

Figure 1:
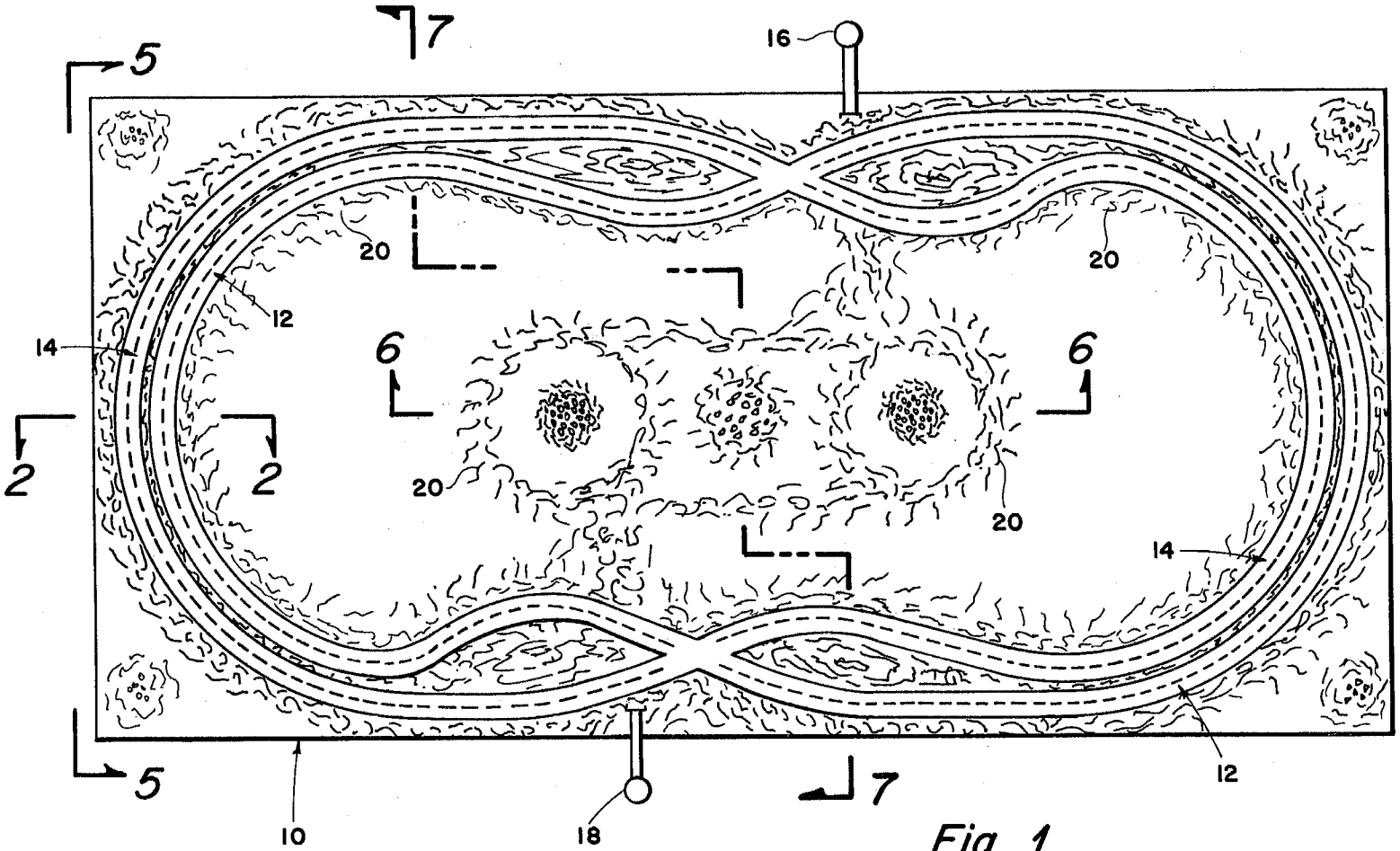
FIG. 1 is a top elevational view of the base showing the intersecting racing tracks and terrain features.

FIG. 1 of the drawings illustrates a top view of the track base, generally indicated by reference numeral 10, said base preferably having a pair of intersecting tracks on the upper surface thereof generally indicated by reference numerals 12 and 14 for racing a pair of rocket sleds (not shown). Handles 16 and 18 extending from the base are controlled by the players to vary the speed of each rocket sled. Plastic "mountains" 20 or similar terrain features formed of other suitably molded materials provide an ornamental background for the racing tracks while concealing the individual air supply ducts underlying each track, the air source and internal control features of the invention.

Figure 2:
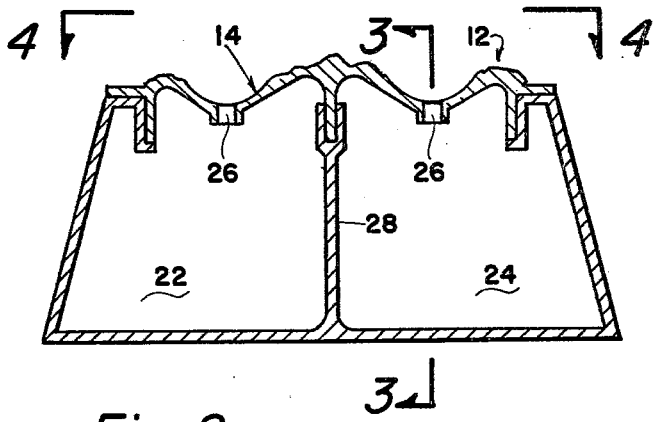
FIG. 2 is a cross-sectional elevation of the tracks along line 2—2 of FIG. 1.
Figure 3:
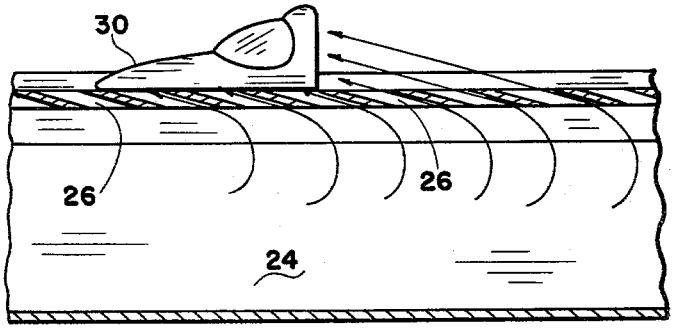
FIG. 3 is a cross-sectional elevation of a section of track taken along line 3—3 of FIG. 2 and a projectile resting thereon.
Figure 4:
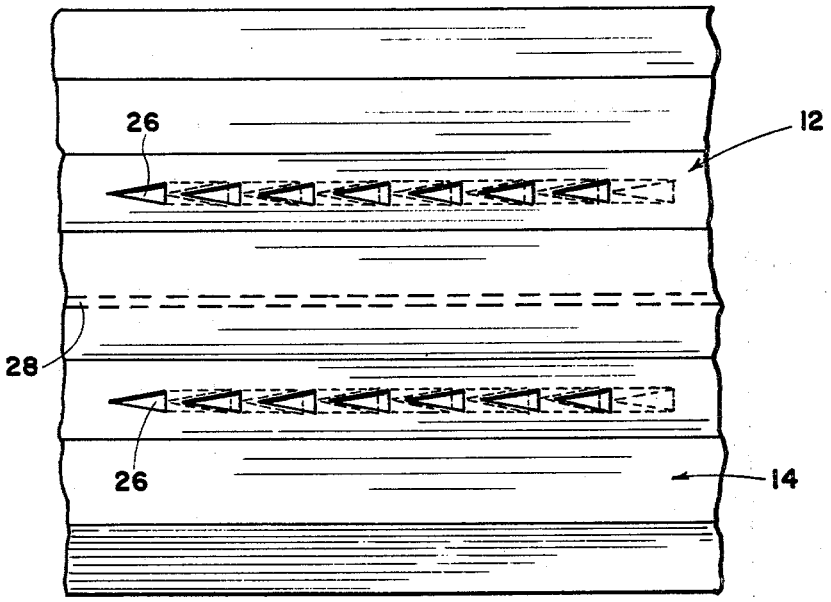
FIG. 4 is a top view of a section of track taken along line 4—4 of FIG. 2.

FIG. 2 of the drawings is a cross-sectional view of tracks 12 and 14 taken along line 2—2 of FIG. 1. The tracks are actually U-shaped platforms or base grooves in cross-sectinal configuration positioned above air ducts 22 and 24. Air ducts 22 and 24 are in open communication with the atmosphere via spaced bores 26, which may be of a triangular shape as shown in the drawings, terminating in the bottom of the grooves. A solid partition 28 prevents communication between the two air ducts and thus differing air pressures may be maintained in each duct. The triangular bores are acutely inclined to the track axis as shown in FIG. 3 so that air flows from the ducts 22 and 24 to the atmosphere in the direction of the arrows. The air flow, thus directed, is used to power a lightweight projectile or rocket sled 30 along each track. The rocket sled configuration is such that the projectile will slidably fit in the track as indicated in FIG. 3 of the drawings. The triangular shape of the bores 26 is clearly revealed in the top view of the tracks shown in FIG. 4.

Figure 5:
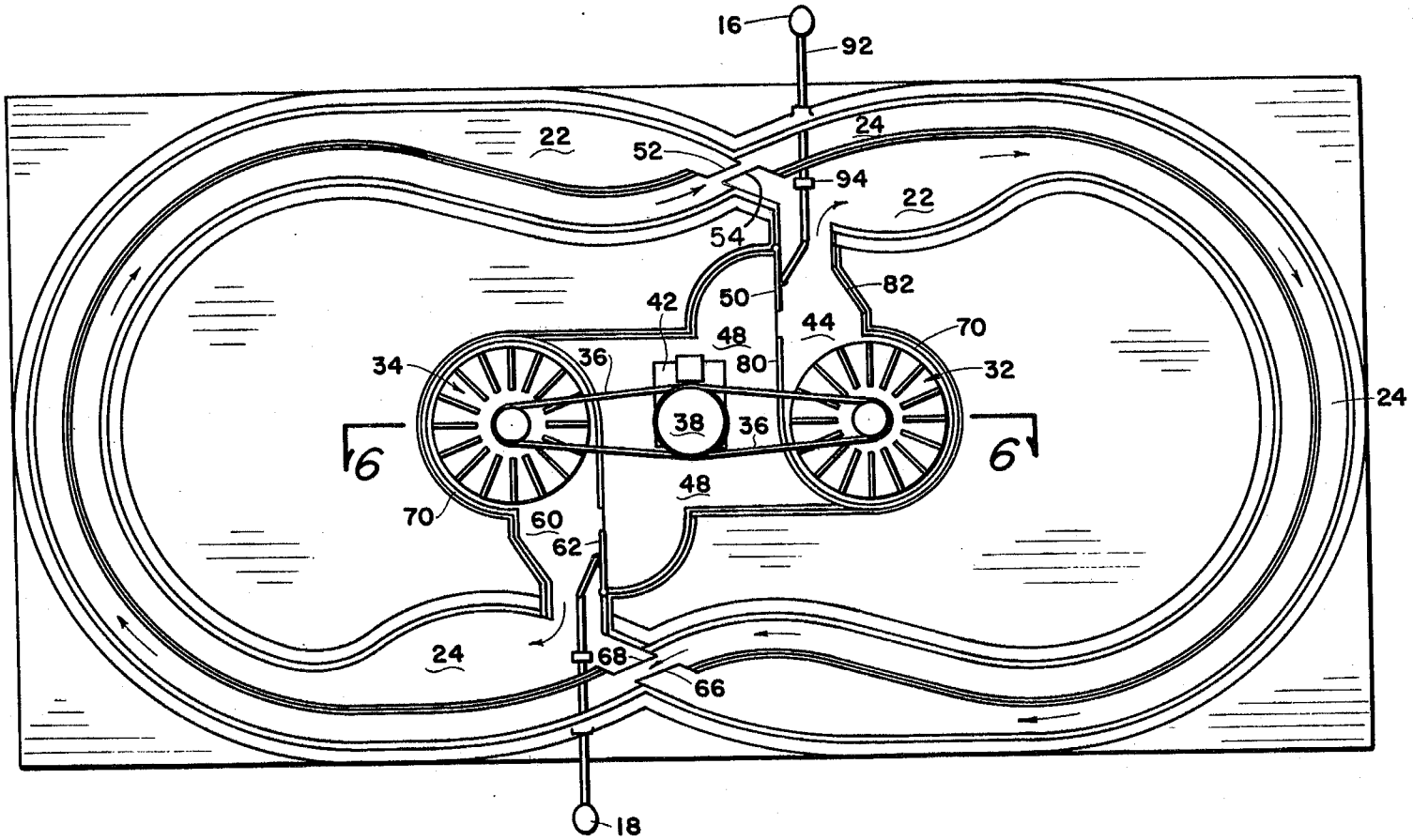
FIG. 5 is a cross-sectional view of the base taken along line 5—5 of FIG. 1.

FIG. 5 is a cross-sectional view of the base 10 taken along line 5—5 of FIG. 1. Air is provided on a continuous basis to ducts 22 and 24 by a pair of centrifugal fans indicated generally by reference numerals 32 and 34. Each of said centrifugal fans are powered by belts 36 driven by a dual sheave 38 mounted on a suitably journalled drive shaft 40 (not shown) operably connected to an electrical motor 42. The effluent air from fan 32 is exhausted via duct 44 to air duct 22 although a portion of the air may be diverted to a central motor chamber 48 by opening gate 50. A diversion of the air to chamber 48 which is open to the atmosphere via apertures 90 thus lowers the rate of air flow from the duct to the atmosphere via triangular bores 26. Partition walls 52 and 54 prevent the duct 22 from forming a closed loop although the inertia of the rocket sled permits the sled to circle the track. Similarly the effluent air from fan 34 is exhausted via exhaust duct 60 to air duct 24 although a portion of said air may also be diverted to the central motor chamber 48 by opening gate 62, thus lowering the air pressure in duct 24 and the consequent rate of air flow from the duct 24 to the atmosphere via the triangular bores. Duct 24 is also prevented from forming a closed loop by means of partition walls 66 and 68. The general direction of air flow within each duct is in accordance with the arrows shown in the figure.

Figure 6:
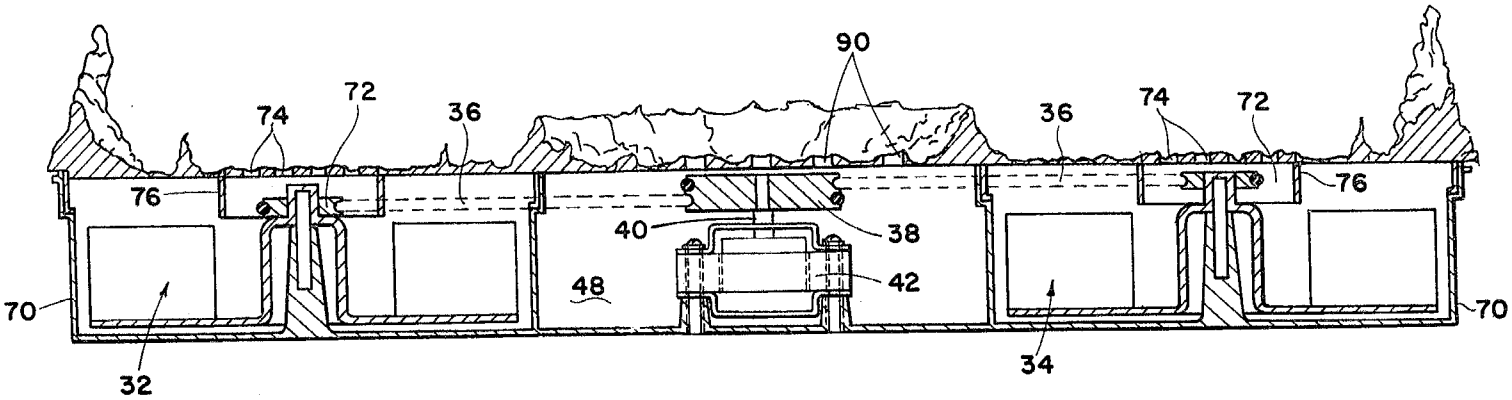
FIG. 6 is a view partly in cross-section taken along line 6—6 of FIG. 1.

A cross-sectional view of the centrifugal fans and drive motor taken along line 6—6 of FIG. 5 is illustrated in FIG. 6. As shown in said figure the fan blades are rotatably mounted in oppositely disposed cylindrical housings 70 having tangential exhaust ducts 44 and 60 (not shown). The center hubs 72 of each centrifugal fan are driven by the action of belts 36. Base 10 has a plurality of apertures 74 substantially centered over the housings 70 which function as air inlet ports for the fans. Cylindrical baffles 76 are provided to aid in channelling the inlet air flow to the axial center of each fan.

Figure 7:
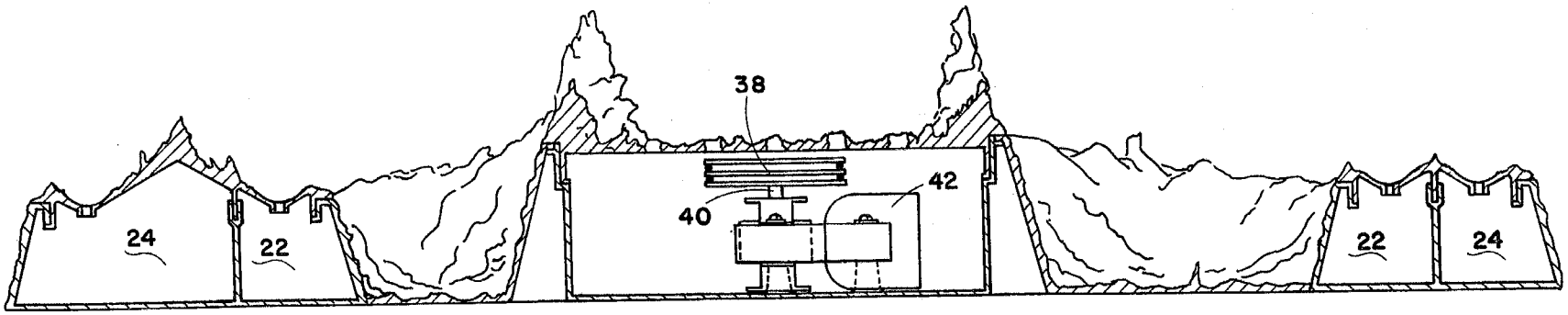
FIG. 7 is a view partly in cross-section taken along line 7—7 of FIG. 1.

FIG. 7 is a second cross-sectional elevation taken along line 7—7 of FIG. 5.

The air supply to ducts 22 and 24 underlying the racing tracks may be varied by adjusting the position of gates 50 and 62. While the following discussion is limited to the operation of gate 50, it is to be understood that the oppositely disposed gate 62 functions in precisely the same manner.

The vertical side walls of exhaust duct 44 are formed by a first partition 80 extending tangentially from the cylindrical fan housing 70 and an oppositely disposed second partition 82. Duct 44 and the adjacent central motor chamber 48 are in open communication by means of opening 86 in the common partition 80. Gate 50 is pivotally hinged to partition 80 along the far edge of opening 86 from the fan proper and has a width somewhat greater than the width of opening 86. Thus by pivoting gate 50 about its hinged edge, the air flow form fan 32 may be diverted into duct 22 to power the rocket sled or into motor chamber 48 from where it is vented to the atmosphere via apertures 90. Any intermediate position selected for the gate will permit a division of the air flow between the air duct 22 and central motor chamber 48 thus enabling the operator to vary the speed of the rocket sled. As each operator has equal quantities of air flow available, from the separate but commonly powered fans the winner of the race will normally depend upon the skill of the operator in maneuvering his or her sled through the curved track portions without mishap.

Figure 8:
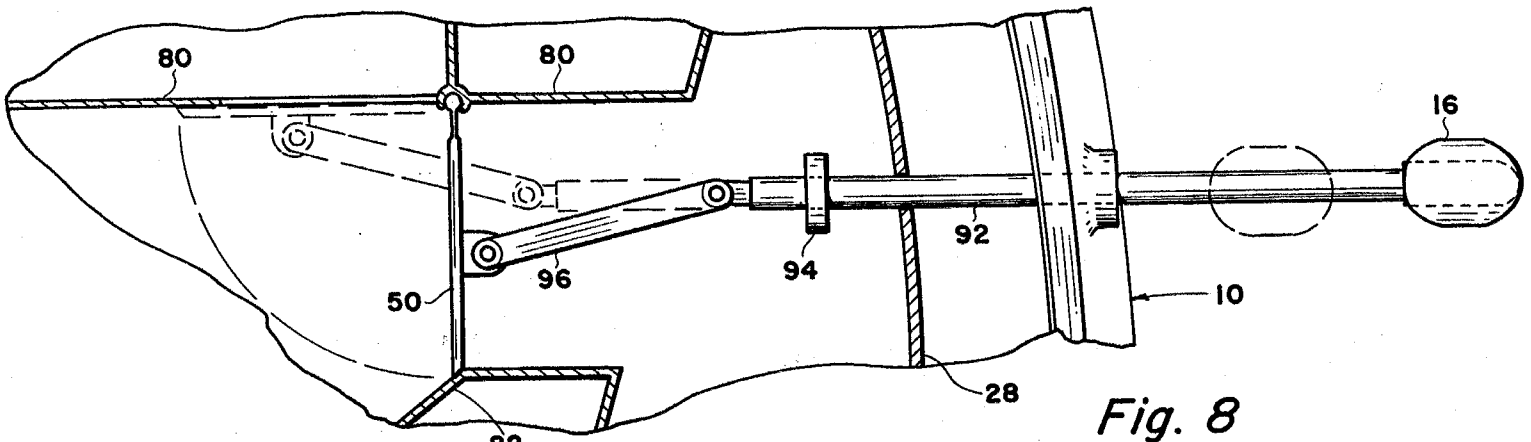
FIG. 8 is a top view of the air control gate.
Figure 9:
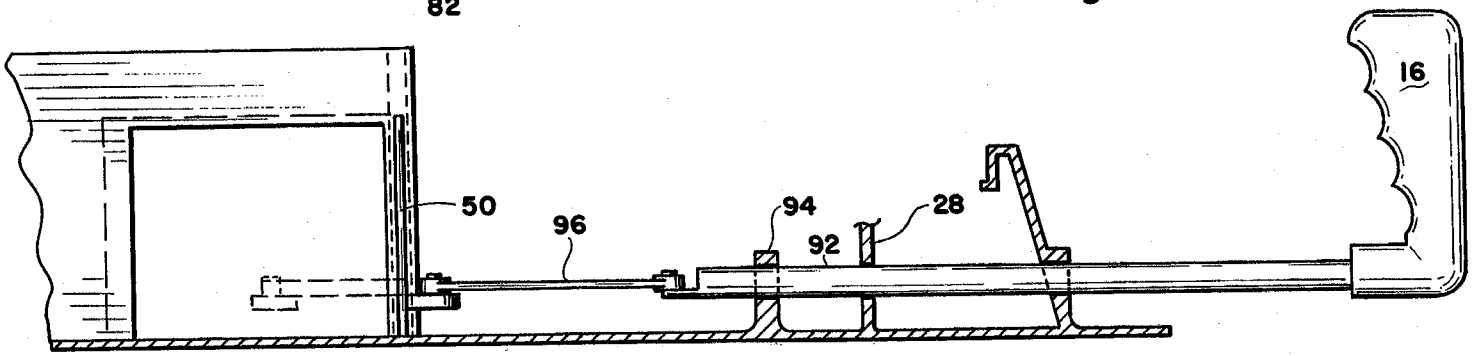
FIG. 9 is a side view of the air control gate.

The actual mechanism employed to adjust the gate position may take many forms, however, the preferred means is illustrated in FIGS. 8 and 9. Rod 92 extends through an opening in the sidewall of base 10 and is slidably mounted through ear 94 which is secured to the base. A handle 16 is affixed to the end of the rod extending from the base for ease in manually sliding said rod in a back and forth motion. Strut 96 is pivotally hinged at one end to the end of rod 92 and at the other end to gate 50. The hinging of strut 96 in this manner allows for the necessary angular articulation of gate 50 in opening and closing as rod 92 is moved in a reciprocal motion.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An apparatus for a rocket sled game comprising:
(a) a base compartment, at least one elongated substantially enclosed passageway in the interior of the base compartment, at least one elongated grooved track provided in the upper outside surface of the base compartment, each track being in communication with a separate passageway through a plurality of spaced bores along the upper surface of the passageway;
(b) a projectile sled adapted for slidably fitting in each said grooved track for travelling in a single direction along said track;
(c) each bore of said plurality of bores being inclined from the vertical, the upper ends of each bore being directed toward the direction of travel of said projectile sled; and
(d) separate means for selectively introducing a flow of air into one end of each passageway in a direction opposite to the direction of travel of the projectile, to thereby force each projectile sled along its grooved track by the flow of air passing from each passageway through the bores.

2. A rocket sled game as recited in claim 1 wherein said separate means for selectively introducing a flow of air into one end of each passageway comprises a motor chamber provided in the base compartment said motor chamber being in open communication with the atmosphere, a single motor disposed in the motor chamber, a separate blower compartment in communication with one end of each passageway, a fan member disposed in each blower compartment, each fan member operably connected to the motor and having an atmospheric intake port and an exhaust port, and valve means interposed between the fan exhaust port and said end of the passageway.

3. A rocket sled game as set forth in claim 2 wherein the means for selectively introducing a flow of air into one end of each air passageway further comprises an air port between the exhaust port of each fan member and the motor chamber, a diverter valve operably connected between each air port and its associated air passageway, a valve operator member operably connected to each diverter valve for selective and continuous diversion of the exhaust air from each fan through the air port into the motor chamber and into one end of each air passageway whereby each said blower produces a continuous flow of air, the speed control of each projectile being provided by the positioning of the diverter valve.

4. A rocket sled game as recited in claim 1 having two closed grooved tracks and associated passageways wherein each said track is of substantially the same length.

5. A rocket sled game as recited in claim 4 wherein the two grooved tracks crisscross at at least one position but wherein the air passageways are not in open communication with each other.

* * * * *